US006055758A

United States Patent [19]

Vieweg

[11] Patent Number: 6,055,758

[45] Date of Patent: May 2, 2000

[54] FIREARM

[76] Inventor: Thomas Vieweg, 777 Mount Ave., Wyandanch, N.Y. 11798

[21] Appl. No.: 09/032,013

[22] Filed: Jan. 29, 1998

Related U.S. Application Data

[63] Continuation of application No. 08/574,207, Dec. 18, 1995, abandoned.

[51] Int. Cl.[7] ..... F41A 9/61

[52] U.S. Cl. ..... 42/7

[58] Field of Search ..... 42/50, 7, 18, 22

[56] References Cited

U.S. PATENT DOCUMENTS

| | | | |
|---|---|---|---|
| 4,936,037 | 6/1990 | Holcomb et al. | 42/106 |
| 5,099,595 | 3/1992 | Chestnut et al. | 42/50 |
| 5,438,783 | 8/1995 | Sniezak et al. | 42/7 |
| 5,526,600 | 6/1996 | Chestnut et al. | 42/50 |
| 5,642,582 | 7/1997 | Grams | 42/50 |
| 5,704,148 | 1/1998 | Valorose | 42/50 |

*Primary Examiner*—Charles T. Jordan
*Assistant Examiner*—Denise J Buckley

[57] ABSTRACT

A base plate for a pistol with a recessed handle for a magazine comprising, a base plate having a generally rectangular central extent with parallel sides and an arcuate front slidably coupleable to the lower extent of a magazine positionable within a handle recess. The base plate has folded-over side regions located above the central extent and spaced therefrom and a folded-over arcuate front region located adjacent to the central extent at the front of the base plate and between the side regions. The folded-over arcuate front regions are crimped to form an abutment surface. The side regions are adapted to be slid over side flanges of a magazine to close the lower extent of the magazine. The base plate is fabricated of hardened stamped steel.

1 Claim, 3 Drawing Sheets

FIG 1
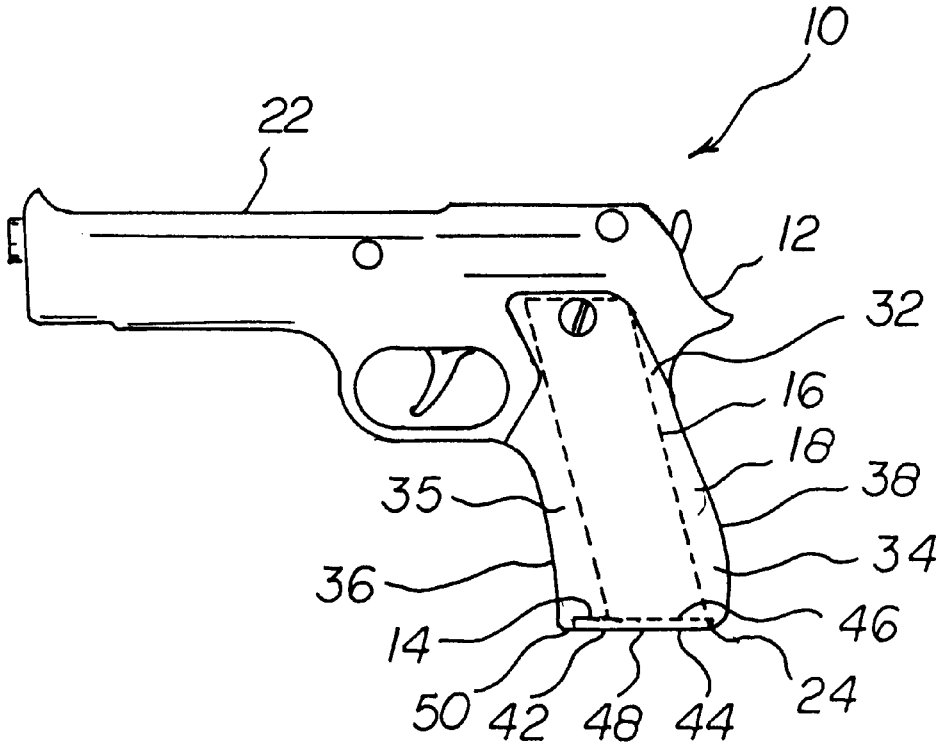
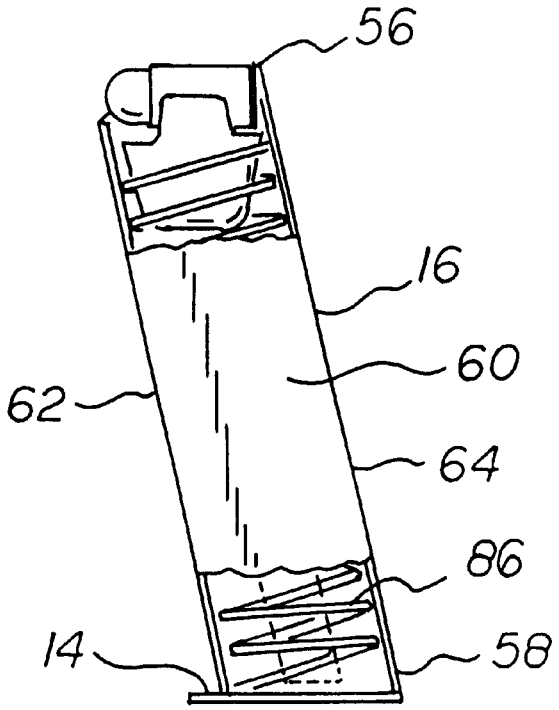
FIG 2

FIG 3
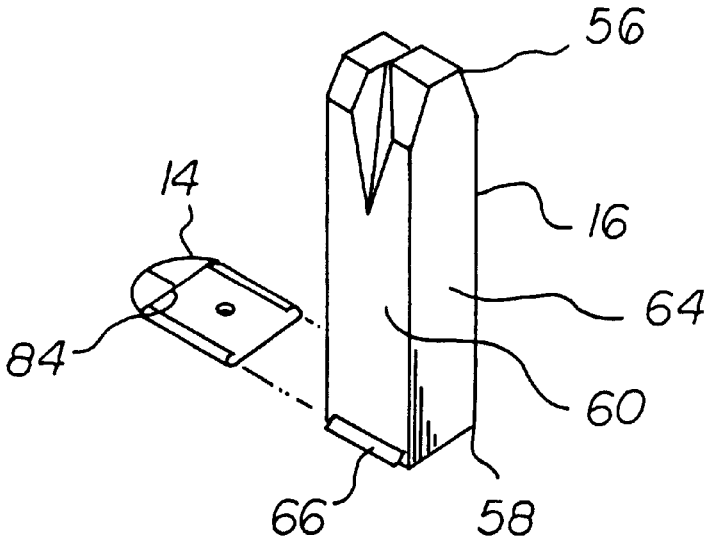
FIG 4
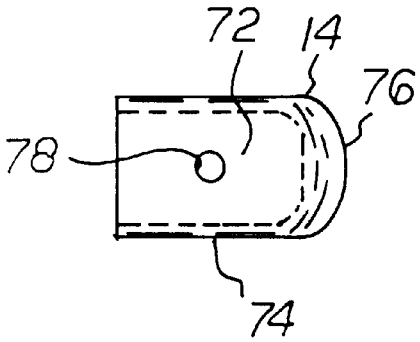
FIG 6
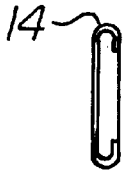
FIG 7
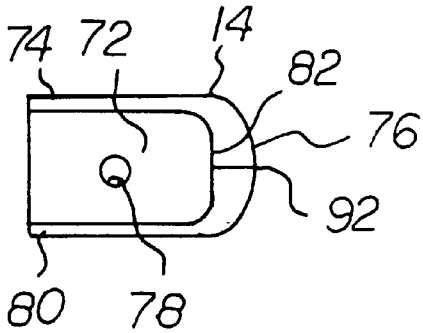
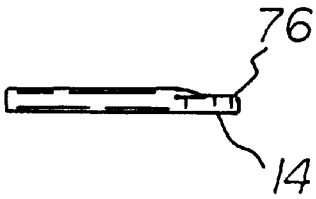
FIG 5
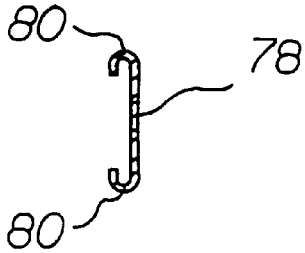
FIG 8

FIREARM

RELATED APPLICATIONS

The present application is a continuation application of an application filed Dec. 18, 1995 and assigned Ser. No. 08/574,207.

BACKGROUND OF THE INVENTION

1. Field of the Invention

The present invention relates to a new and improved impact resistant base plate for a magazine totally positionable within a pistol handle and, more particularly, pertains to increasing the life of a magazine while reducing its size.

2. Description of the Prior Art

The use of firearms and components of various designs and configurations are known in the prior art. More specifically, Firearms and components of various designs and configurations heretofore devised and utilized for the purpose of increasing the efficiency of firearms through various methods and apparatuses are known to consist basically of familiar, expected, and obvious structural configurations, notwithstanding the myriad of designs encompassed by the crowded prior art which has been developed for the fulfillment of countless objectives and requirements.

The prior art discloses a large number of firearms and components of various designs and configurations. By way of example, U.S. Pat. No. 5,461,811 to Ciener illustrates a cartridge magazine for a gun which includes a machined magazine body. U.S. Pat. No. 4,514,922 to Farrar et al. illustrates a magazine structure wherein the magazine is stamped from a single piece of sheet metal. U.S. Pat. No. 5,438,783 to Sniezak et al. illustrates a handgun magazine assembly. U.S. Pat. No. 4,862,619 to Baldus et al. illustrates a magazine which is a one piece cast or molded element. Lastly, U.S. Pat. No. 2,185,676 to Moneta and U.S. Pat. No. 1,400,252 to Weed both illustrate firearm magazine cartridges.

In this respect, the impact resistant base plate for a magazine totally positionable within a pistol according to the present invention substantially departs from the conventional concepts and designs of the prior art, and in doing so provides an apparatus primarily developed for the purpose of Increasing the life of a magazine while reducing its size.

Therefore, it can be appreciated that there exists a continuing need for a new and improved impact resistant base plate for a magazine totally positionable within a pistol which can be used for Increasing the life of a magazine while reducing its size. In this regard, the present invention substantially fulfills this need.

SUMMARY OF THE INVENTION

In view of the foregoing disadvantages inherent in the known types of Firearms and components of various designs and configurations now present in the prior art, the present invention provides a new and improved impact resistant base plate for a magazine totally positionable within a pistol. As such, the general purpose of the present invention, which will be described subsequently in greater detail, is to provide a new and improved impact resistant base plate for a magazine totally positionable within a pistol and methods which have all the advantages of the prior art and none of the disadvantages.

To attain this, the present invention essentially comprises a new and improved pistol with an impact resistant base plate and with a magazine which is full received within the handle comprising, in combination, a generally horizontally disposed barrel having a rearward loading end and a forward end for discharging bullets therefrom. A generally vertically disposed handle has an upper end coupled to the barrel adjacent to the rearward end and a lower end therebeneath. The handle also has generally rectangularly shaped large side faces and generally rectangularly shaped small front and rear faces coupling the sides faces. An opening is formed in the lower end of the handle with an upwardly extending recess of a generally rectilinear configuration forming an upper extent and a lower extent. The recess has a peripheral edge at its lower extent and with the upper extent located adjacent to the rearward end of the barrel. A magazine in a generally rectilinear configuration has an upper extent positionable adjacent to the barrel at the rearward end and a lower extent positionable totally within the peripheral edge of the lower extent of the recess. The magazine also has generally rectangularly shaped large side faces and generally rectangularly shaped small front and rear faces coupling the side faces and with outwardly flared flanges at the lower extent of the side faces. The magazine is adapted to be positioned within the recess with bullets adapted to be positioned within the magazine. A base plate is provided and has a generally rectangular central extent about 1.335 by 1.00 inches with parallel sides and an arcuate front slidably coupled to the lower extent of the magazine. The central extent of the base plate has a central aperture of a diameter of about 0.205 inches. The base plate has folded-over rectangular side regions about 1.335 by 0.090 inches located above the central extent and spaced therefrom by about 0.040 inches and folded-over arcuate front regions located adjacent to the central extent at the front thereof and between the side regions. The folded-over arcuate front regions are crimped to form an abutment surface. The side regions are adapted to be slid over the side flanges to close the lower extent of the magazine. The base plate is fabricated of stamped steel selected from the class of steel including 1050 carbon steel and 410 stainless steel and also heat treated to a hardness of C 38–42 with a thickness of about 0.040 inches to be fit entirely within the recess of the handle. Resilient elements within the magazine tend to urge bullets therein upwardly toward the barrel.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved impact resistant base plate for a magazine totally positionable within a pistol which has all the advantages of the prior art Firearms and components of various designs and configurations and none of the disadvantages.

It is another object of the present invention to provide a new and improved impact resistant base plate for a magazine totally positionable within a pistol which may be easily and efficiently manufactured and marketed.

It is a further object of the present invention to provide a new and improved impact resistant base plate for a magazine totally positionable within a pistol which is of a durable and reliable construction.

An even further object of the present invention is to provide a new and improved impact resistant base plate for a magazine totally positionable within a pistol which is susceptible of a low cost of manufacture with regard to both materials and labor, and which accordingly is then susceptible of low prices of sale to the consuming public, thereby making such a impact resistant base plate for a magazine totally positionable within a pistol economically available to the buying public.

Still yet another object of the present invention is to provide a new and improved impact resistant base plate for a magazine totally positionable within a pistol which provides in the apparatuses and methods of the prior art some of the advantages thereof, while simultaneously overcoming some of the disadvantages normally associated therewith.

Even still another object of the present invention is to Increasing the life of a magazine while reducing its size.

A further object of the invention is to provide an impact resistant base plate for a pistol magazine.

A further object of the invention is to locate the base plate of a pistol magazine totally recessed within the handle.

Lastly, it is an object of the present invention to provide a base plate for a pistol with a recessed handle for a magazine comprising, a base plate having a generally rectangular central extent with parallel sides and an arcuate front slidably coupleable to the lower extent of a magazine positionable within a handle recess. The base plate has folded-over side regions located above the central extent and spaced therefrom and a folded-over arcuate front region located adjacent to the central extent at the front of the base plate and between the side regions. The folded-over arcuate front regions are crimped to form an abutment surface. The side regions are adapted to be slid over side flanges of a magazine to close the lower extent of the magazine. The base plate is fabricated of hardened stamped steel.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a plan view of the preferred embodiment of the impact resistant base plate for a magazine totally positionable within a pistol constructed in accordance with the principles of the present invention.

FIG. 2 is a side plan view of the magazine of the present invention.

FIG. 3 is an exploded perspective illustration of the magazine and associated base plate in a separated orientation.

FIG. 4 is a bottom view of the base plate of the present invention.

FIG. 5 is a side view of the base plate.

FIG. 6 is a rear plan view of the base plate.

FIG. 7 is a top plan view of the base plate.

FIG. 8 is a cross-sectional view of the base plate taken at a central extent thereof.

The same reference numerals refer to the same parts throughout the various Figures.

DESCRIPTION OF THE PREFERRED EMBODIMENT

Figure 9:
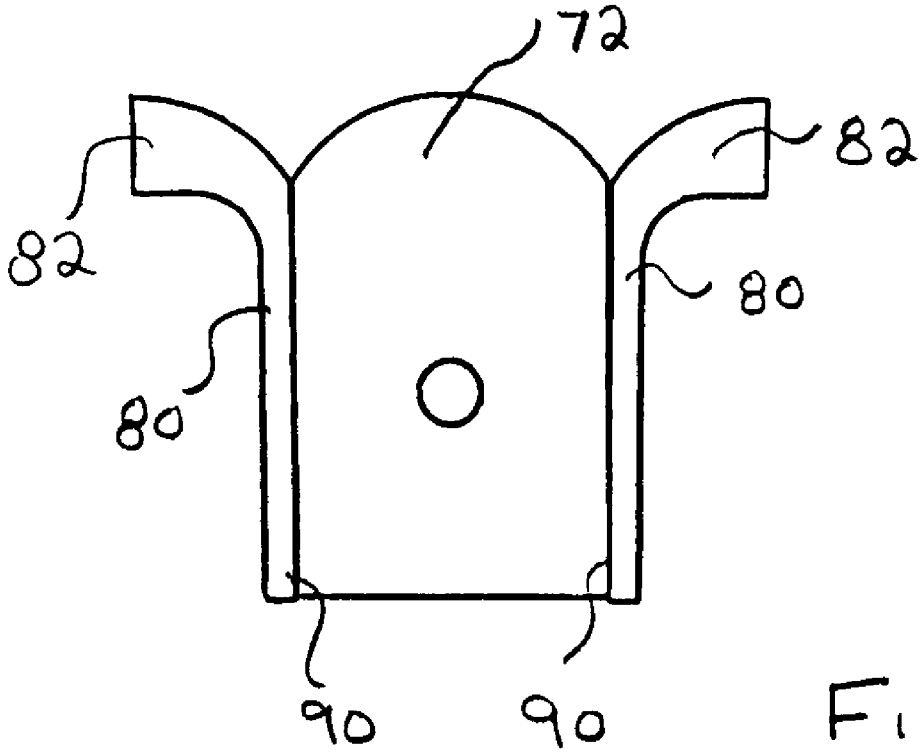
FIG. 9 is a plan view of the cut piece of metal from which the base plate is formed.

With reference now to the drawings, and in particular to FIGS. 1 through 8 thereof, the preferred embodiment of the new and improved impact resistant base plate for a magazine totally positionable within a pistol embodying the principles and concepts of the present invention and generally designated by the reference numeral 10 will be described.

The present invention, the new and improved impact resistant base plate for a magazine totally positionable within a pistol is a system 10 comprised of a plurality of components. Such components, in their broadest context, include a pistol, a magazine and base plate. Each of the individual components is specifically configured and correlated one with respect to the other so as to attain the desired objectives.

The present invention is a system 10. The system includes a pistol 12. The pistol includes an impact resistant base plate 14 with a magazine 16 which is fully received within the handle 18 of the pistol.

The pistol includes a generally horizontally disposed barrel 22. The barrel has a rearward loading end 24. It also has a forward end 26 for discharging bullets from the barrel.

The pistol also includes a generally vertically disposed handle. The handle has an upper end 32 which is coupled to the barrel adjacent to the rearward end. The handle also has a lower end 34 beneath the upper end. The handle is formed to have generally rectangularly shaped large side faces 35 and generally rectangularly shaped small front and rear faces 36 and 38 for coupling the side faces.

An opening 42 is formed in the lower end of the handle. A recess 44 extends upwardly therefrom. The recess is of a generally rectilinear configuration. It forms an upper extent 46 and a lower extent 48. The recess has a peripheral edge 50 at its lower extent. The upper extent is located adjacent to the rearward end of the barrel.

Next provided is a magazine. Such magazine is in a generally rectilinear configuration. It has an upper extent 56 positionable adjacent to the barrel at the rearward end. It also has a lower extent 58 positionable totally within the peripheral edge 50 of the lower extent of the recess. The magazine also has generally rectangular shaped large side faces 60 and generally shaped small front and rear faces 62 and 64 coupling the side faces. Outwardly flared flanges 66 are formed at the lower extent of the side faces. The magazine is thus adapted to be positioned within the recess with bullets adapted to be positioned within the magazine.

Provided next is a base plate having a generally rectangular central extent 72 about 1.335 by 1.00 inches with parallel sides 74 and an arcuate front 76. The base plate is slidably coupled to the lower extent of the magazine. The central extent of the base plate has a central aperture 78 of a diameter of about 0.205 inches. The base plate also has folded-over rectangular side regions 80 about 1.335 by 0.090 inches located above the central extent and spaced thereabove by about 0.040 inches. There are also provided folded-over arcuate front regions 82 located adjacent to the central extent at the front thereof and between the side regions. The folded-over arcuate front regions are crimped to form an abutment surface. The side regions are thus adapted to be slid over the side flanges of the magazine to close the lower extent of the magazine.

The base plate is fabricated of stamped steel. Such steel is selected from the class of steel including 1050 carbon steel and 410 stainless steel. Such steel is also heat treated to a hardness of C 38–42. The base plate also has a thickness of about 0.040 inches to be fit entirely within the recess of the handle.

The last component of the system 10 are resilient elements 86 within the magazine. Such elements tend to urge bullets therein upwardly toward the barrel.

The structure of the base plate 14 enables it to be manufactured in a stamping and folding and crimping operation or process, as opposed to a machining process. Such operation and process begins with a planar sheet of metal. This sheet is then cut into the shape depicted in FIG. 9. This cutout is defined by central extent 72 and sides 80. In a subsequent step, the sides 74 are folded, or bent, over onto the central extent 72, preferably through a progressive die. Such folding takes place along fold lines 90. As a consequence, the edges of the arcuate front regions 82 meet along a seam 92. Additionally, the folded over rectangular side regions have curved cross sections. The arcuate front regions 82 are then essentially crimped in a secondary closing operation in order to create an abutment surface. As a result of the crimping, the base plate 14 has a reduced thickness at the arcuate front portion 76. The central extent is thus of a first thickness while the lateral edges are of a second thickness greater than the first thickness while the front is of a third thickness greater than the first thickness but less than the second thickness. This configuration is more clearly depicted in FIG. 5.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pistol with an impact resistant base plate and a handle and a magazine which is fully received within the handle comprising, in combination:

a horizontally disposed barrel having a rearward loading end and a forward end for discharging bullets therefrom;

a vertically disposed handle having an upper end coupled to the barrel adjacent to the rearward end and a lower end therebeneath, the handle also having rectangularly shaped large side faces and rectangularly shaped small front and rear faces coupling the side faces;

an opening formed in the lower end of the handle with an upwardly extending recess of a rectilinear configuration forming an upper extent and a lower extent, the recess having a peripheral edge at its lower extent and with the upper extent located adjacent to the rearward end of the barrel;

a magazine in a rectilinear configuration having an upper extent positionable adjacent to the barrel at the rearward end and a lower extent positionable totally within the peripheral edge of the lower extent of the recess, the magazine also having rectangularly shaped large side faces and rectangularly shaped small front and rear faces coupling the side faces and with outwardly flared flanges at the lower extent of the side faces, the magazine adapted to be positioned within the recess with bullets adapted to be positioned within the magazine;

a base plate having a rectangular central extent about 1.335 by 1.00 inches with parallel sides and an arcuate front slidably coupled to the lower extent of the magazine, the central extent of the base plate having a central aperture of a diameter of about 0.205 inches, the base plate having folded-over rectangular side regions about 1.335 by 0.090 inches located above the central extent and spaced therefrom by about 0.040 inches, the folded over rectangular side regions having curved cross sections, and folded-over arcuate front regions located adjacent to the central extent at the front thereof and between the side regions, the folded-over arcuate front regions being crimped to form an abutment surface, the side regions adapted to be slid over the side flanges to close the lower extent of the magazine, the base plate being fabricated of stampable steel selected from the class of stampable steels including 1050 carbon steel and 410 stainless steel, the stampable steel also heat treated, and formed to a thickness of about 0.04 inches to be fit entirely within the recess of the handle; and resilient elements within the magazine tending to urge bullets therein upwardly toward the barrel.

* * * * *